US010041305B2

(12) United States Patent
Jain

(10) Patent No.: US 10,041,305 B2
(45) Date of Patent: Aug. 7, 2018

(54) ACTIVELY CONTROLLED SELF-ADJUSTING BITS AND RELATED SYSTEMS AND METHODS

(71) Applicant: Baker Hughes Incorporated, Houston, TX (US)

(72) Inventor: Jayesh Rameshlal Jain, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 294 days.

(21) Appl. No.: 14/851,117

(22) Filed: Sep. 11, 2015

(65) Prior Publication Data

US 2017/0074047 A1 Mar. 16, 2017

(51) Int. Cl.
*E21B 10/62* (2006.01)
*E21B 7/06* (2006.01)

(52) U.S. Cl.
CPC ..... *E21B 10/62* (2013.01); *E21B 7/064* (2013.01); *E21B 2010/622* (2013.01)

(58) Field of Classification Search
CPC ..... E21B 2010/622; E21B 7/064; E21B 10/62–10/633; E21B 10/32; E21B 10/322; E21B 10/54; E21B 10/42–10/43; E21B 17/1014
USPC ..... 175/263–292
See application file for complete search history.

(56) References Cited

U.S. PATENT DOCUMENTS 1,612,338 A 12/1926 Wilson et al.
2,815,932 A 12/1957 Wolfram
3,050,122 A 8/1962 Huitt
3,422,672 A 1/1969 Payne
3,583,501 A 6/1971 Aalund
(Continued)

FOREIGN PATENT DOCUMENTS

WO 2005097383 A1 10/2005
WO 2009134842 A2 11/2009
WO 2017044763 A1 3/2017

OTHER PUBLICATIONS

Jain et al., U.S. Appl. No. 14/973,282, Earth-Boring Tools Including Passively Adjustable, Agressiveness-Modifying Members and Related Methods, filed Dec. 17, 2015.
(Continued)

*Primary Examiner* — George S Gray
(74) *Attorney, Agent, or Firm* — TraskBritt

(57) ABSTRACT

An actively controlled self-adjusting earth-boring tool includes a body carrying cutting elements and an actuation device disposed at least partially within the body. The actuation device may include a first fluid chamber, a second fluid chamber, and a reciprocating member dividing the first fluid chamber from the second fluid chamber. A connection member may be attached to the reciprocating member and may have a drilling or bearing element connected thereto. A first fluid flow path may extend from the second fluid chamber to the first fluid chamber. A second fluid flow path may extend from the first fluid chamber to the second fluid chamber. A rate controller may control a flowrate of a hydraulic fluid through the first and second fluid flow paths. The rate controller may include an electromagnet, and the flowrates of the hydraulic fluid may be adjusted by adjusting fluid properties of the hydraulic fluid.

16 Claims, 9 Drawing Sheets

(56) References Cited

U.S. PATENT DOCUMENTS

| | | | | |
|---|---|---|---|---|
| 4,375,239 | A | 3/1983 | Barrington et al. | |
| 4,386,669 | A | 6/1983 | Evans | |
| 4,662,458 | A | 5/1987 | Ho | |
| 4,856,601 | A | 8/1989 | Raney | |
| 5,042,596 | A | 8/1991 | Brett et al. | |
| 5,553,678 | A | 9/1996 | Barr et al. | |
| 5,842,149 | A | 11/1998 | Harrell et al. | |
| 5,967,247 | A | 10/1999 | Pessier | |
| 6,021,377 | A | 2/2000 | Dubinsky et al. | |
| 6,123,160 | A | 9/2000 | Tibbitts | |
| 6,142,250 | A | 11/2000 | Griffin et al. | |
| 6,157,893 | A | 12/2000 | Berger et al. | |
| 6,173,797 | B1 | 1/2001 | Dykstra et al. | |
| 6,253,863 | B1 | 7/2001 | Mensa-Wilmot et al. | |
| 6,349,780 | B1 | 2/2002 | Beuershausen | |
| 6,785,641 | B1 | 8/2004 | Huang | |
| 7,430,153 | B2 | 9/2008 | Fraser et al. | |
| 7,523,792 | B2 | 4/2009 | El-Rayes et al. | |
| 7,721,823 | B2 | 5/2010 | Radford | |
| 7,866,413 | B2 | 1/2011 | Stauffer et al. | |
| 7,921,937 | B2 | 4/2011 | Brackin et al. | |
| 7,971,662 | B2 | 7/2011 | Beuershausen | |
| 8,061,455 | B2 | 11/2011 | Beuershausen | |
| 8,205,686 | B2 | 6/2012 | Beuershausen | |
| 8,443,875 | B2 | 5/2013 | Lee | |
| 8,739,884 | B2 | 6/2014 | Lake | |
| 8,768,726 | B1 | 7/2014 | Cave | |
| 8,925,654 | B2 | 1/2015 | Zahradnik | |
| 9,080,399 | B2 | 7/2015 | Oesterberg | |
| 9,255,450 | B2 | 2/2016 | Jain et al. | |
| 9,663,995 | B2 | 5/2017 | Jain | |
| 9,708,859 | B2 | 7/2017 | Jain et al. | |
| 2003/0146305 | A1 | 8/2003 | Gurich et al. | |
| 2003/0166470 | A1* | 9/2003 | Fripp | E21B 21/10 507/100 |
| 2005/0096847 | A1 | 5/2005 | Huang | |
| 2007/0114065 | A1 | 5/2007 | Hall | |
| 2007/0221416 | A1 | 9/2007 | Hall et al. | |
| 2007/0272445 | A1 | 11/2007 | Cariveau et al. | |
| 2008/0000693 | A1 | 1/2008 | Hutton | |
| 2008/0041593 | A1 | 2/2008 | Brown et al. | |
| 2009/0044979 | A1 | 2/2009 | Johnson et al. | |
| 2009/0097985 | A1 | 4/2009 | Lea-Wilson | |
| 2009/0107722 | A1 | 4/2009 | Chen et al. | |
| 2010/0071956 | A1 | 3/2010 | Beuershausen | |
| 2010/0157735 | A1 | 6/2010 | Allan et al. | |
| 2010/0212964 | A1 | 8/2010 | Beuershausen | |
| 2010/0270085 | A1 | 10/2010 | Turner et al. | |
| 2012/0106297 | A1 | 5/2012 | Fraser | |
| 2012/0255788 | A1 | 10/2012 | Schwefe et al. | |
| 2012/0318580 | A1 | 12/2012 | Oesterberg | |
| 2013/0025358 | A1 | 1/2013 | Radford et al. | |
| 2013/0081880 | A1 | 4/2013 | Schwefe et al. | |
| 2014/0311801 | A1 | 10/2014 | Jain et al. | |
| 2014/0332271 | A1 | 11/2014 | Do et al. | |
| 2014/0332283 | A1 | 11/2014 | Do et al. | |
| 2014/0356419 | A1 | 12/2014 | Gujral et al. | |
| 2015/0191979 | A1* | 7/2015 | Jain | E21B 10/54 175/57 |
| 2016/0032658 | A1 | 2/2016 | Jain | |
| 2016/0053551 | A1 | 2/2016 | Jain et al. | |
| 2017/0074047 | A1 | 3/2017 | Jain | |
| 2017/0175454 | A1 | 6/2017 | Ricks et al. | |
| 2017/0175455 | A1 | 6/2017 | Jain et al. | |
| 2017/0268312 | A1* | 9/2017 | Haake | E21B 33/13 |

OTHER PUBLICATIONS

Ricks et al., U.S. Appl. No. 14/972,635 entitiled Self-Adjusting Earth-Boring Tools and Related Systems and Methods filed Dec. 17, 2015.

Jain et al., Mitigation of Torsional Stick-Slip Vibrations in Oil Well Drilling Through PCD Bit Design: Putting Theories to the Test, SPE 146561, Soiciet of Petroleum Engineers, 2011, pp. 1-13.

Jain, Jayesh R., Drill Bit with Self-Adjusting Gage Pads, U.S. Appl. No. 14/516,069, filed Oct. 16, 2014.

Jain et al., Modeling and Simulation of Drill Strings with Adaptive Systems, U.S. Appl. No. 14/516,203 dated Oct. 16, 2014.

International Search Report for International Application No. PCT/US2016/050971 dated Nov. 28, 2016, 3 pages.

International Written Opinion for International Application No. PCT/US2016/050971 dated Nov. 28, 2016, 10 pages.

* cited by examiner

ACTIVELY CONTROLLED SELF-ADJUSTING BITS AND RELATED SYSTEMS AND METHODS

TECHNICAL FIELD

This disclosure relates generally to actively controlled self-adjusting bits for use in drilling wellbores, to bottom hole assemblies and systems incorporating actively controlled self-adjusting bits, and to methods and using such actively controlled self-adjusting bits, assemblies, and systems.

BACKGROUND

Oil wells (wellbores) are usually drilled with a drill string. The drill string includes a tubular member having a drilling assembly that includes a single drill bit at its bottom end. The drilling assembly typically includes devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit attached to the bottom end of the drilling assembly is rotated by rotating the drill string from the drilling rig and/or by a drilling motor (also referred to as a "mud motor") in the bottom hole assembly ("BHA") to remove formation material to drill the wellbore. A large number of wellbores are drilled along non-vertical, contoured trajectories in what is often referred to as directional drilling. For example, a single wellbore may include one or more vertical sections, deviated sections and horizontal sections extending through differing types of rock formations.

When drilling with a fixed cutter, or so-called "drag" bit progresses from a soft formation, such as sand, to a hard formation, such as shale, or vice versa, the rate of penetration ("ROP") changes, and excessive ROP fluctuations and/or vibrations (lateral or torsional) may be generated in the drill bit. The ROP is typically controlled by controlling the weight-on-bit ("WOB") and rotational speed (revolutions per minute or "RPM") of the drill bit. WOB is controlled by controlling the hook load at the surface and RPM is controlled by controlling the drill string rotation at the surface and/or by controlling the drilling motor speed in the drilling assembly. Controlling the drill bit vibrations and ROP by such methods requires the drilling system or operator to take actions at the surface. The impact of such surface actions on the drill bit fluctuations is not substantially immediate. Drill bit aggressiveness contributes to the vibration, whirl and stick-slip for a given WOB and drill bit rotational speed. "Depth of Cut" (DOC) of a fixed-cutter drill bit, is generally defined as the effective exposure of cutting elements above the adjacent face of the bit, and is a significant contributing factor relating to the drill bit aggressiveness. Controlling DOC can prevent excessive formation material buildup on the bit (e.g., "bit balling"), limit reactive torque to an acceptable level, enhance steerability and directional control of the bit, provide a smoother and more consistent diameter borehole, avoid premature damage to the cutting elements, and prolong operating life of the drill bit.

BRIEF SUMMARY OF THE INVENTION

In some embodiments, the present disclosure includes an earth-boring tool having a body, an actuation device, and a drilling or bearing element. The actuation device may be disposed at least partially within the body. The actuation device may include a first fluid chamber, a second fluid chamber, at least one reciprocating member, a hydraulic fluid, a connection member, a first fluid flow path, and a first rate controller. The at least one reciprocating member may divide the first fluid chamber from the second fluid chamber, and the at least one reciprocating member may be configured to reciprocate back and forth within the first fluid chamber and the second fluid chamber. The hydraulic fluid may be disposed within the first fluid chamber and the second fluid chamber. The connection member may be attached to the at least one reciprocating member at a portion of the at least one reciprocating member facing the second fluid chamber. The connection member may extend out of the second fluid chamber. The first fluid flow path may extend from the second fluid chamber to the first fluid chamber. A first flow control device may be disposed within the first fluid flow path. The first rate controller may be disposed proximate the first fluid flow path and the first flow control device. The first rate controller may be configured to control a flowrate of the hydraulic fluid through the first fluid flow path and the first flow control device by adjusting a viscosity of the hydraulic fluid. The drilling element may be attached to the connection member of the actuation device.

Additional embodiments of the present disclosure include an earth-boring tool having a body, an actuation device, and a drilling element. The actuation device may be disposed at least partially within the body. The actuation device may include a first fluid chamber, a second fluid chamber, at least one reciprocating member, a connection member, a divider member, a first fluid flow path, a second fluid flow path, a first rate controller, and a second rate controller. The second fluid chamber may have a first portion and a second portion. The at least one reciprocating member may divide the first fluid chamber from the first portion of the second fluid chamber. The at least one reciprocating member may be configured to reciprocate back and forth within the first fluid chamber and the first portion of the second fluid chamber. The connection member may be attached to the reciprocating member at a portion of the reciprocating member facing the first portion of the second fluid chamber, and the connection member may extend out of the second fluid chamber. The divider member may divide the first fluid chamber from the second portion of the second fluid chamber. The first fluid flow path may extend from the second portion of the second fluid chamber to the first fluid chamber. The second fluid flow path may extend from the first fluid chamber to the first portion of the second fluid chamber. The first rate controller may extend around the first fluid flow path. The first rate controller may be configured to control a flowrate of a hydraulic fluid through the first fluid flow path. The second rate controller may extend around the second fluid flow path. The second rate controller may be configured to control a flowrate of the hydraulic fluid through the second fluid flow path. The drilling element may be attached to the connection member of the actuation device.

Yet further embodiments of the present disclosure include an actuation device for an actively controlled self-adjusting earth-boring tool. The actuation device may include an external casing, an internal casing, a pressure compensator housing, an internal chamber, a reciprocating member, a connection member, a drilling or bearing element, a first fluid flow path, a second fluid flow path, a first rate controller, and a second rate controller. The internal casing may be housed by the external casing. The pressure compensator housing may be housed by the external casing. The internal chamber may be within the internal casing. The reciprocating member may sealingly divide the internal chamber into a first fluid chamber and a first portion of a second fluid chamber. The pressure compensator housing may define a second portion of the second fluid chamber. The connection member may be attached to a portion of the reciprocating member facing the first portion of the second fluid chamber. The connection member may extend through the second fluid chamber and through an extension hole defined in the external casing. The drilling element may be attached to the connection member and may be configured to be extended and retracted through the extension hole of the external casing. The first fluid flow path may have a first flow control device disposed therein and may extend from the second portion of the second fluid chamber to the first fluid chamber. The second fluid flow path may have a second flow control device disposed therein and may extend from the first fluid chamber to the first portion of the second fluid chamber, wherein the first portion of the second fluid chamber is in fluid communication with the second portion of the second fluid chamber via a third fluid flow path. The first rate controller may be disposed proximate the first flow control device of the first fluid flow path and may comprise a first electromagnet. The second rate controller may be disposed proximate the second flow control device of the second fluid flow path and may comprise a second electromagnet.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

The illustrations presented herein are not actual views of any particular drilling system, drilling tool assembly, or component of such an assembly, but are merely idealized representations which are employed to describe the present invention.

As used herein, any relational term, such as "first," "second," etc., is used for clarity and convenience in understanding the disclosure and accompanying drawings, and does not connote or depend on any specific preference or order, except where the context clearly indicates otherwise.

Some embodiments of the present disclosure include an actively controlled self-adjusting drill bit for use in a wellbore. For example, the actively controlled self-adjusting drill bit may include an actuation device for extending and retracting a drilling element (e.g., a cutting element) of the bit. The drilling element may be attached to a reciprocating member within the actuation device, and the reciprocating member may extend and retract the drilling element by moving through inward and outward strokes. The reciprocating member may divide a chamber of the actuation device into a first fluid chamber and a second fluid chamber. The movement of the reciprocating member and, as a result, the movement of the drilling element may be controlled by controlling flowrates of a hydraulic fluid that is allowed to flow between the first fluid chamber and the second fluid chamber responsive to the reciprocating movement of the reciprocating member. In some embodiments of the present disclosure, the flowrates of the hydraulic fluid may be controlled by controlling fluid properties of the hydraulic fluid. For example, the hydraulic fluid may include a magneto rheological fluid, and the actuation device may include at least one electromagnet located and configured to adjust the viscosity of the hydraulic fluid, and, as a result, a flowrate of the hydraulic fluid. In some embodiments, the at least one magnet may be actively controlled (e.g., the magnet may be controlled in real time to produce a magnetic field with a desired magnetic flux density in order to achieve a desired viscosity of the hydraulic fluid). In other words, the flowrates of the hydraulic fluid between the first fluid chamber and the second fluid chamber may be actively controlled. In some embodiments, the flowrates of the hydraulic fluid may be actively controlled by a control unit disposed in a bit body of the bit. Furthermore, because the flowrates can be actively controlled, extension rates, retraction rates, and positions of the drilling element can be actively controlled.

Figure 1:
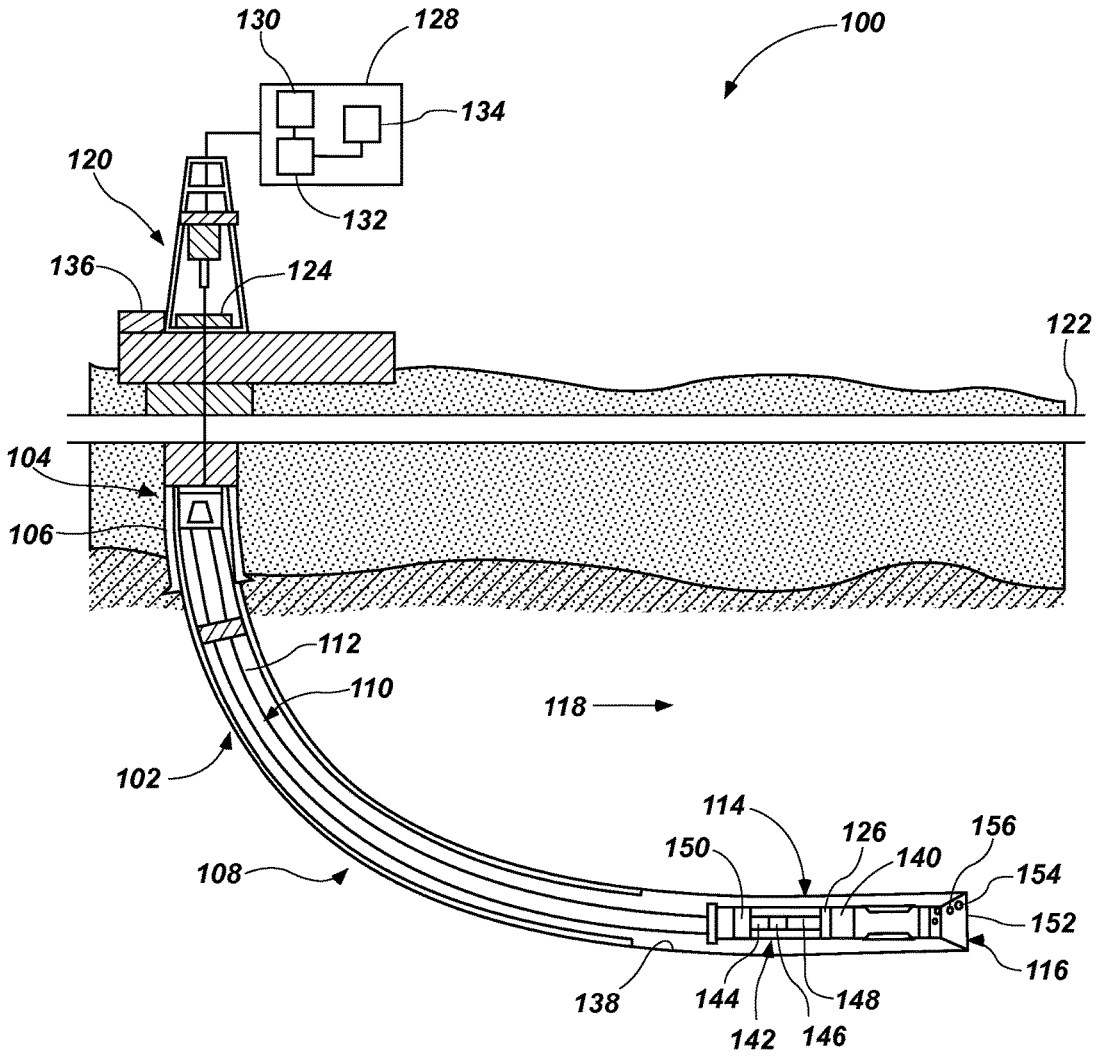
FIG. 1 is a schematic diagram of a wellbore system comprising a drill string that includes an actively controlled self-adjusting drill bit according to an embodiment of the present disclosure.

FIG. 1 is a schematic diagram of an example of a drilling system 100 that may utilize the apparatuses and methods disclosed herein for drilling wellbores. FIG. 1 shows a wellbore 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the wellbore 102 of a selected diameter in a formation 118.

The drill string 110 may extend to a rig 120 at the surface 122. The rig 120 shown is a land rig 120 for ease of explanation. However, the apparatuses and methods disclosed equally apply when an offshore rig 120 is used for drilling wellbores under water. A rotary table 124 or a top drive may be coupled to the drill string 110 and may be utilized to rotate the drill string 110 and to rotate the drilling assembly 114, and thus the drill bit 116 to drill the wellbore 102. A drilling motor 126 (also referred to as a "mud motor") may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the wellbore 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a flash memory, a magnetic tape, a hard disk, and an optical disk. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside wall 138 of the wellbore 102.

The drilling assembly 114 may further include one or more downhole sensors 140 (collectively designated by numeral 140). The sensors 140 may include any number and type of sensors 140, including, but not limited to, sensors 140 generally known as the measurement-while-drilling (MWD) sensors 140 or the logging-while-drilling (LWD) sensors 140, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank and/or crown of a bit body the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

The drill bit 116 may include a face section 152 (or bottom section). The face section 152 or a portion thereof may face the undrilled formation 118 in front of the drill bit 116 at the wellbore 102 bottom during drilling. In some embodiments, the drill bit 116 may include one or more cutting elements that may be extended and retracted from a surface, such as the face section 152, of the drill bit 116. An actuation device 156 may control the rate of extension and retraction of a drilling element 154 from the drill bit 116. In some embodiments, the actuation device 156 may control a rate of rotation of the drilling element 154 relative to the drill bit 116. In some embodiments, the actuation device 156 may control a rate of movement in a curvilinear fashion of the drilling element 154 relative to the drill bit 116. In some embodiments, the actuation device 156 may actively control the rate of extension and retraction of the drilling element 154 from the drill bit 116. In other embodiments, the actuation device 156 may be a passive device that automatically adjusts or self-adjusts the rate of extension and retraction of the drilling element 154 based on or in response to a force or pressure applied to the drilling element 154 during drilling. In some embodiments, the actuation device 156 and drilling element 154 may be actuated by contact of the drilling element 154 with the formation 118. In some drilling operations, substantial forces may be experienced on the drilling elements 154 when a depth of cut ("DOC") of the drill bit 116 is changed rapidly. Accordingly, the actuation device 156 may be configured to resist sudden changes to the DOC of the drill bit 116. In some embodiments, the rate of extension and retraction of the drilling element 154 may be preset and/or actively controlled, as described in more detail in reference to FIGS. 2-9.

Figure 2:
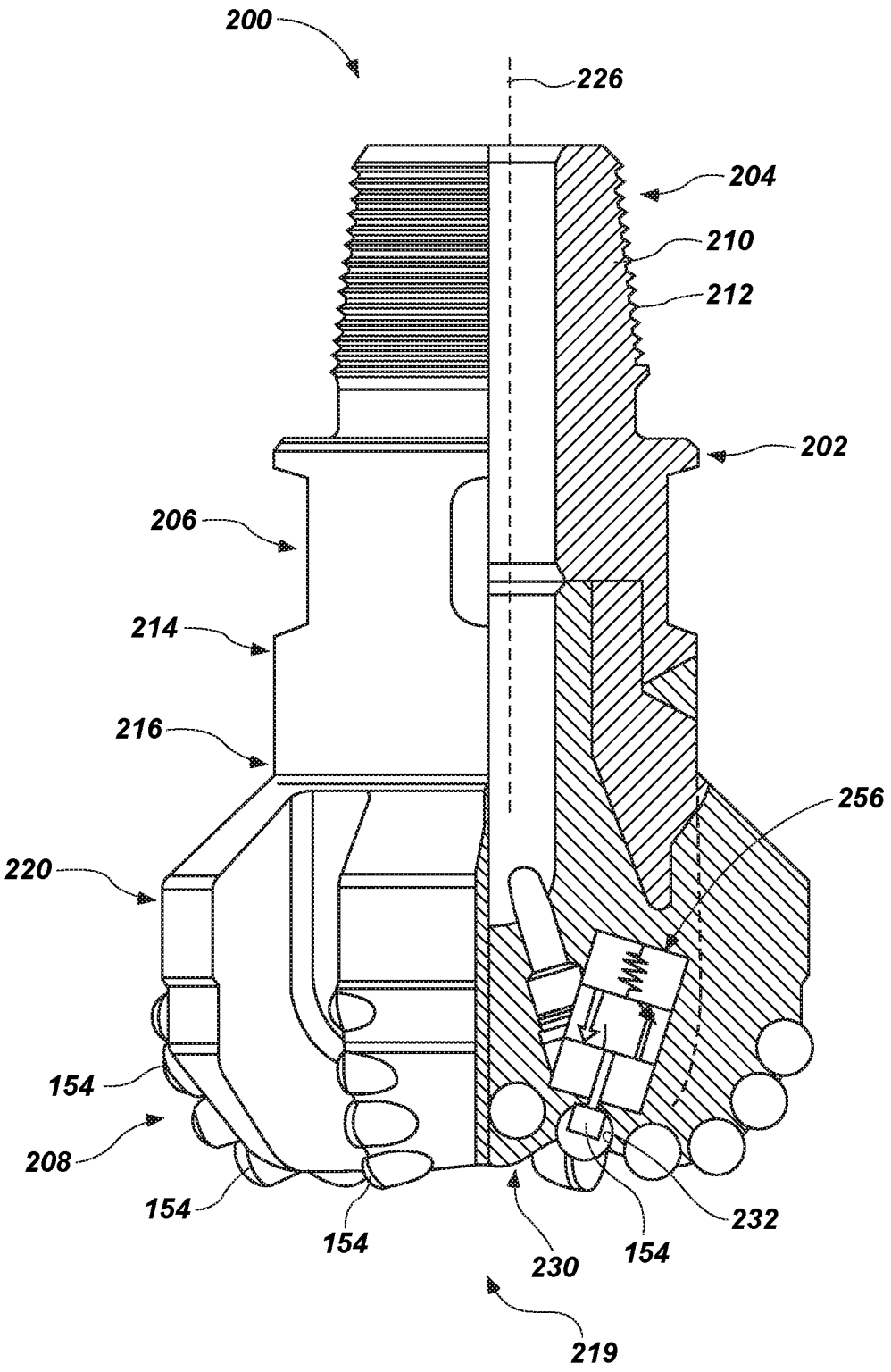
FIG. 2 is a is a partial cross-sectional view of an actively controlled self-adjusting drill bit according to an embodiment of the present disclosure.

FIG. 2 shows an earth-boring tool 200 having an actuation device 256 according to an embodiment of the present disclosure. In some embodiments, the earth-boring tool 200 includes a fixed-cutter polycrystalline diamond compact (PDC) bit having a bit body 202 that includes a neck 204, a shank 206, and a crown 208. The earth-boring tool 200 may be any suitable drill bit or formation removal device for use in a formation of any suitable downhole rotary tool. For example, the earth-boring tool 200 may include a drill bit, reamer bit, impact tool, hole opener, etc.

The neck 204 of the bit body 202 may have a tapered upper end 210 having threads 212 thereon for connecting the earth-boring tool 200 to a box end of the drilling assembly 114 (FIG. 1). The shank 206 may include a lower straight section 214 that is fixedly connected to the crown 208 at a joint 216. The crown 208 may include a number of blades 220. Each blade 220 may have multiple regions as known in the art (cone, nose, shoulder, gage).

The earth-boring tool 200 may include one or more drilling or bearing elements 154 (referred to hereinafter as "drilling elements 154") that extend and retract from a surface 230 of the earth-boring tool 200. For example, the bit body 202 of the earth-boring tool 200 may carry (e.g., have attached thereto) a plurality of drilling elements 154. The drilling elements 154 may include, for example, cutting elements, pads, elements making rolling contact, elements that reduce friction with formations, PDC bit blades, cones, elements for altering junk slot geometry, etc. As shown in FIG. 2, the drilling element 154 may be movably disposed in a cavity or recess 232 in the crown 208. An actuation device 256 may be coupled to the drilling element 154 and may be configured to control rates at which the drilling element 154 extends and retracts from the earth-boring tool 200 relative to a surface 230 of the earth-boring tool 200. In some embodiments, the actuation device 256 may be oriented with a longitudinal axis 226 of the actuation device 256 oriented at an acute angle (e.g., a tilt) relative to a direction of rotation of the earth-boring tool 200 in order to minimize a tangential component of a friction force experienced by the actuation device 256. In some embodiments, the actuation device 256 may be disposed inside the blades 220 supported by the bit body 202 and may be secured to the bit body 202 with a press fit proximate a face 219 of the earth-boring tool 200. In some embodiments, the actuation device 256 may be disposed within a gage region of a bit body 202. For example, the actuation device 256 may be coupled to a gage pad and may be configured to control rates at which the gage pad extends and retracts from the gage region of the bit body of 202. For example, the actuation device 256 may be disposed within a gage region similar to the actuation devices described in U.S. patent application Ser. No. 14/516,069, to Jain, now U.S. Pat. No. 9,663,995, issued May 30, 2017, the disclosure of which is incorporated in its entirety herein by this reference.

Figure 3:
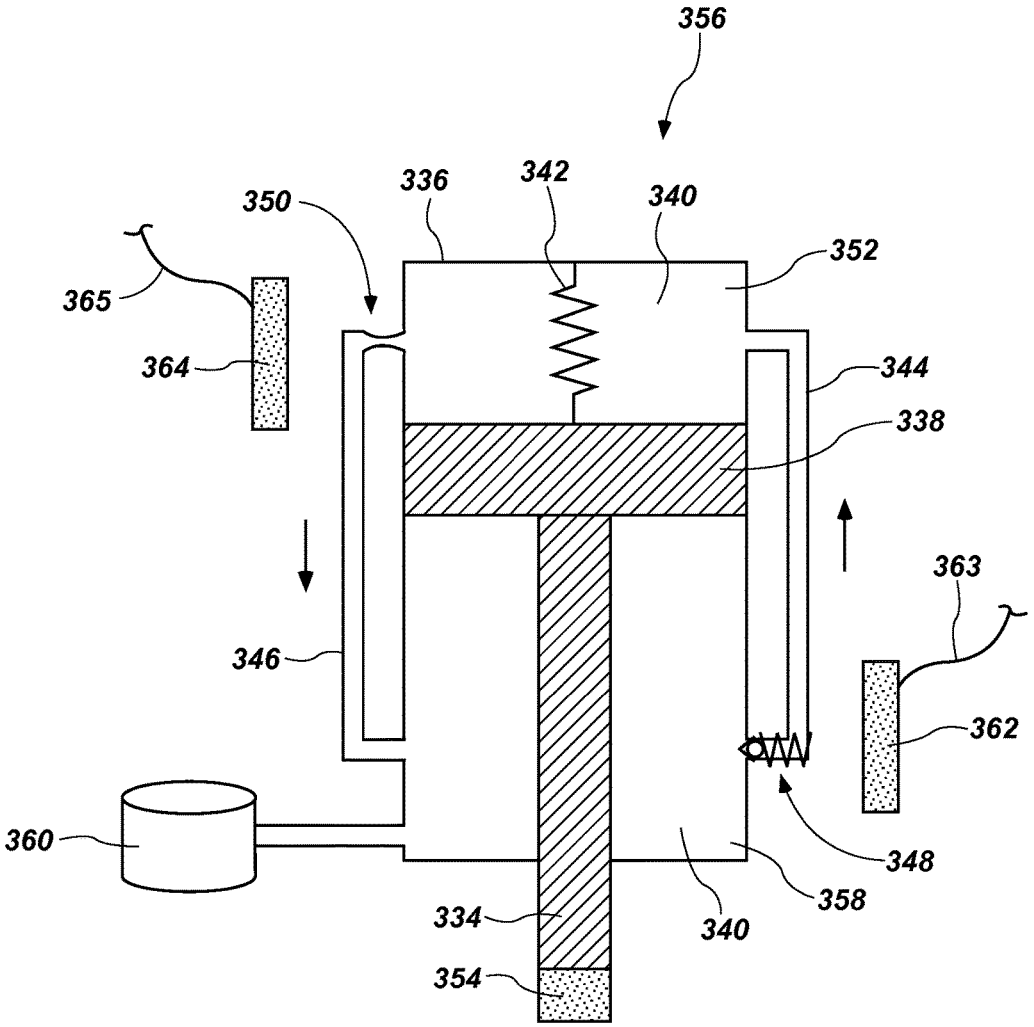
FIG. 3 is a schematic representation of an actuation device of an actively controlled self-adjusting drill bit according to an embodiment of the present disclosure.

FIG. 3 shows a schematic view of an actuation device 356 of the actively controlled self-adjusting earth-boring tool 200 (FIG. 2) according to an embodiment of the present disclosure. The actuation device 356 may include a connection member 334, a chamber 336, a reciprocating member 338, a hydraulic fluid 340, a biasing member 342, a first fluid flow path 344, a second fluid flow path 346, a first flow control device 348, a second flow control device 350, a pressure compensator 360, and a drilling element 354. The chamber 336 may be sealingly divided by the reciprocating member 338 (e.g., piston) into a first fluid chamber 352 and a second fluid chamber 358. The first fluid chamber 352 and the second fluid chamber 358 may be at least substantially filled with the hydraulic fluid 340. The hydraulic fluid 340 may include any hydraulic fluid 340 suitable for downhole use, such as oil. The hydraulic fluid 340 may include one or more of a magneto-rheological fluid and an electro-rheological fluid.

In some embodiments, the first and second fluid chambers 352 and 358 may be in fluid communication with each other via the first fluid flow path 344 and second fluid flow path 346. The first fluid flow path 344 may extend from the second fluid chamber 358 to the first fluid chamber 352 and may allow the hydraulic fluid 340 to flow from the second fluid chamber 358 to the first fluid chamber 352. The first flow control device 348 may be disposed within the first fluid flow path 344 and may be configured to control the flowrate of the hydraulic fluid 340 from the second fluid chamber 358 to the first fluid chamber 352. In some embodiments, the first flow control device 348 may include one or more of a first check valve and a first restrictor (e.g., an orifice). In some embodiments, the first flow control device 348 may include only a first check valve. In other embodiments, the first flow control device 348 may include only a first restrictor. In other embodiments, the first flow control device 348 may include both the first check valve and the first restrictor.

The second fluid flow path 346 may extend from the first fluid chamber 352 to the second fluid chamber 358 and may allow the hydraulic fluid 340 to flow from the first fluid chamber 352 to the second fluid chamber 358. The second flow control device 350 may be disposed within the second fluid flow path 346 and may be configured to control the flowrate of the hydraulic fluid 340 from the first fluid chamber 352 to the second fluid chamber 358. In some embodiments, the second flow control device 350 may include one or more of a second check valve and a second restrictor (e.g., orifice). In some embodiments, the second flow control device 350 may include only a second check valve. In other embodiments, the second flow control device 350 may include only a second restrictor. In other embodiments, the second flow control device 350 may include both the second check valve and the second restrictor.

The connection member 334 may be connected at a first end to a portion of the reciprocating member 338 facing the second fluid chamber 358. The connection member 334 may be connected to the drilling element 354 at a second opposite end of the connection member 334. The biasing member 342 (e.g., a spring) may be disposed in the first fluid chamber 352 and may be attached to the reciprocating member 338 on a side of the reciprocating member 338 opposite the connection member 334 and may be configured to exert a force on the reciprocating member 338 and to move the reciprocating member 338 outward toward a formation 118 (FIG. 1). For example, the biasing member 342 may move the reciprocating member 338 outward, which may in turn move the drilling element 354 outward (i.e., extend the drilling element 354). Such movement of the reciprocating member 338 and drilling element 354 may be referred to herein as an "outward stroke." As the reciprocating member 338 moves outward, the reciprocating member 338 may expel hydraulic fluid 340 from the second fluid chamber 358, through the first fluid flow path 344, and into the first fluid chamber 352.

In some embodiments, the second fluid chamber 358 may be at a pressure at least substantially equal to an environment pressure, and the first fluid chamber 352 may be at a pressure higher than the pressure of the second fluid chamber 358. In some embodiments, the pressure differential between the first fluid chamber 352 and the second fluid chamber 358 may assist in applying a selected force on the reciprocating member 338 and moving the reciprocating member 338 through the outward stroke.

In some embodiments, the second fluid chamber 358 may be maintained at a pressure at substantially equal to an environment pressure (e.g., pressure outside of earth-boring tool 200 (FIG. 2)) with the pressure compensator 360, which may be in fluid communication with the second fluid chamber 358. The pressure compensator 360 may include a bellows, diaphragm, pressure compensator valve, etc. For example, the pressure compensator 360 may include a diaphragm that is in fluid communication with the environment (e.g., mud of wellbore 102 (FIG. 1)) on one side and in fluid communication with the hydraulic fluid 340 in the second fluid chamber 358 on another side and may at least substantially balance the pressure of the second fluid chamber 358 with the environment pressure.

Referring still to FIG. 3, during operation, when the drilling element 354 contacts the formation 118 (FIG. 1), the formation 118 (FIG. 1) may exert a force on the drilling element 354, which may move the reciprocating member 338 inward. Moving the reciprocating member 338 inwards may push the hydraulic fluid 340 from the first fluid chamber 352, through the second fluid flow path 346, and into the second fluid chamber 358, which may in turn move the drilling element 354 inward (i.e., retract the drilling element 354). Such movement of the reciprocating member 338 and drilling element 354 may be referred to herein as an "inward stroke."

The rate of the movement of the reciprocating member 338 (e.g., the speed at which the reciprocating member 338 moves through the outward and inward strokes) and the position of the reciprocating member 338 may be controlled by the flowrates of the hydraulic fluid 340 through the first and second fluid flow paths 344, 346 and the first and second flow control devices 348, 350. As a result, the rate of the movement of the drilling element 354 (e.g., the speed at which drilling element 354 extends and retracts) and the position of the drilling element 354 relative to the surface 230 (FIG. 2) may be controlled by the flowrates of the hydraulic fluid 340 through the first and second fluid flow paths 344, 346 and the first and second flow control devices 348, 350.

In some embodiments, the flowrates of the hydraulic fluid 340 may be set or dynamically adjusted by controlling hydraulic fluid 340 flows between the first and second fluid chambers 352, 358. The flowrates of the hydraulic fluid 340 through the first and second fluid flow paths 344, 346 and the first and second flow control devices 348, 350 may be controlled by adjusting fluid properties of the hydraulic fluid 340. For example, the actuation device 356 may include one or more rate controllers for adjusting the fluid properties of the hydraulic fluid 340. In some embodiments, the flowrates of the hydraulic fluid 340 may be actively controlled by adjusting fluid properties by using electro- or magneto-rheological fluids as the hydraulic fluid 340 and magnetic controllers to adjust fluid properties (e.g., viscosity) of the hydraulic fluid 340. In other embodiments, piezo electronics are utilized to control fluid flows.

In some embodiments, the actuation device 356 may include a first rate controller 362 and a second rate controller 364 for adjusting the fluid properties of the hydraulic fluid 340. The first rate controller 362 may be disposed proximate the first fluid flow path 344 and the first flow control device 348, and the second rate controller 364 may be disposed proximate the second fluid flow path 346 and the second flow control device 350. For example, the first and second rate controllers 362, 364 may be oriented adjacent to the first and second fluid flow paths 344, 346, respectively, within the earth-boring tool 200 (FIG. 2). In some embodiments, the first and second rate controllers 362, 364 may be annular in shape (e.g., a coil) and may extend around the first and second fluid flow paths 344, 346, respectively (e.g., the fluid flow paths may be within the coils). In other embodiments, the first and second rate controllers 362, 364 may include a plurality of portions, which may be spaced around the first and second fluid flow paths 344, 346, respectively. For example, each of the first and second rate controllers 362, 364 may each include a plurality of electromagnet coils.

In some embodiments, the hydraulic fluid 340 may include a magneto-rheological fluid and the first and second rate controllers 362, 364 may include electromagnets having lines 363, 365 extending from the first and second rate controllers 362, 364 to one or more of the surface control unit 128 (FIG. 1) and the controller unit 142 (FIG. 1). In some embodiments, the first and second rate controllers 362, 364 may include lines 363, 365 extending from the first and second rate controllers 362, 364 to the controller unit 142 (FIG. 1) and not to the surface control unit 128 (FIG. 1). In other embodiments, the first and second rate controllers 362, 364 may include lines 363, 365 extending from the first and second rate controllers 362, 364 to the surface control unit 128 (FIG. 1) and not to the controller unit 142 (FIG. 1). In other embodiments, the first and second rate controllers 362, 364 may include lines 363, 365 extending from the first and second rate controllers 362, 364 to both the controller unit 142 (FIG. 1) and the surface control unit 128 (FIG. 1). In some embodiments, the lines 363, 365 may include one or more of power and communication lines.

The first electromagnet may be configured to produce a first magnetic field for adjusting the fluid properties of the hydraulic fluid 340 in and around the first flow control device 348 within the first fluid flow path 344. For example, when the first electromagnet produces a magnetic field, a viscosity of the hydraulic fluid 340 subject to the magnetic field may increase. In other words, the first electromagnet may be configured to adjust the viscosity of the hydraulic fluid 340 in and around the first flow control device 348 and within the first fluid flow path 344. Increasing the viscosity of the hydraulic fluid 340 may decrease a flowrate of the hydraulic fluid 340 through the first flow control device 348 and the first fluid flow path 344. As a result, increasing the viscosity of the hydraulic fluid 340 in and around the first flow control device 348 and within the first fluid flow path 344 may decrease a flowrate of the hydraulic fluid 340 from the second fluid chamber 358 to the first fluid chamber 352. Accordingly, by increasing the viscosity of the hydraulic fluid 340 in and around the first flow control device 348 and within the first fluid flow path 344, the first electromagnet can effectively decrease the rate of the movement of the reciprocating member 338 outward (i.e., outward stroke) and, as a result, decrease the rate at which the drilling element 354 extends. Furthermore, decreasing the viscosity of the hydraulic fluid 340 may increase a flowrate of the hydraulic fluid 340 through the first flow control device 348 and the first fluid flow path 344. As a result, decreasing the viscosity of the hydraulic fluid 340 in and around the first flow control device 348 and within the first fluid flow path 344 increases a flowrate of the hydraulic fluid 340 from the second fluid chamber 358 to the first fluid chamber 352. Accordingly, by decreasing the viscosity of the hydraulic fluid 340 in and around the first flow control device 348 and within the first fluid flow path 344, the first electromagnet can effectively increase the rate of the movement of the reciprocating member 338 outward (i.e., outward stroke) and, as a result, increase the rate at which the drilling element 354 extends.

Likewise, the second electromagnet may be configured to produce a second magnetic field for adjusting the fluid properties of the hydraulic fluid 340 in and around the second flow control device 350 within the second fluid flow path 346. The second electromagnet may be configured to adjust the viscosity of the hydraulic fluid 340 in and around the second flow control device 350 within the second fluid flow path 346. Increasing the viscosity of the hydraulic fluid 340 may decrease a flowrate of the hydraulic fluid 340 through the second flow control device 350 and the second fluid flow path 346. As a result, increasing the viscosity of the hydraulic fluid 340 in and around the second flow control device 350 and within the second fluid flow path 346 may decrease a flowrate of the hydraulic fluid 340 from the first fluid chamber 352 to the second fluid chamber 358. Accordingly, by increasing the viscosity of the hydraulic fluid 340 in and around the second flow control device 350 and within the second fluid flow path 346, the second electromagnet can effectively decrease the rate of the movement of the reciprocating member 338 inward (i.e., inward stroke) and, as a result, decrease the rate at which the drilling element 354 retracts. Furthermore, decreasing the viscosity of the hydraulic fluid 340 may increase a flowrate of the hydraulic fluid 340 through the second flow control device 350 and the second fluid flow path 346. As a result, decreasing the viscosity of the hydraulic fluid 340 in and around the second flow control device 350 and within the second fluid flow path 346 increases a flowrate of the hydraulic fluid 340 from the first fluid chamber 352 to the second fluid chamber 358. Accordingly, by decreasing the viscosity of the hydraulic fluid 340 in and around the second flow control device 350 and within the second fluid flow path 346, the second electromagnet can effectively increase the rate of the movement of the reciprocating member 338 inward (i.e., inward stroke) and, as a result, increase the rate at which the drilling element 354 retracts.

In some embodiments, the viscosities of the hydraulic fluid 340 near and around the first and second flow control devices 348, 350 may be set to provide a slow outward stroke of the drilling element 354 and a fast inward stroke of the drilling element 354. In other embodiments, the viscosities of the hydraulic fluid 340 near and around the first and second flow control devices 348, 350 may be set to provide a fast outward stroke of the drilling element 354 and a slow inward stroke of the drilling element 354.

In some embodiments, the viscosities of the hydraulic fluid 340 near and around the first and second flow control devices 348, 350 may be set to provide constant fluid flowrate exchange between the first fluid chamber 352 and the second fluid chamber 358. Constant fluid flowrates may provide a first constant rate for the extension for the reciprocating member 338 and a second constant rate for the retraction of the reciprocating member 338 and, thus, corresponding constant rates for extension and retraction of the drilling element 354. In some embodiments, the fluid flow rate through the first fluid flow path 344 may be set such that when the earth-boring tool 200 (FIG. 2) is not in use, i.e., there is no external force being applied onto the drilling element 354, the biasing member 342 will extend the drilling element 354 to a maximum extended position. In some embodiments, the first flow control device 348 may be configured so that the biasing member 342 extends the drilling element 354 relatively fast or suddenly.

In some embodiments, the fluid flow rates through the second fluid flow path 346 may be configured to allow a relatively slow flowrate of the hydraulic fluid 340 from the first fluid chamber 352 into the second fluid chamber 358, thereby causing the drilling element 354 to retract relative to the surface 230 (FIG. 2) relatively slowly. For example, the extension rate of the drilling element 354 may be set so that the drilling element 354 extends from the fully retracted position to a fully extended position over a few seconds while it retracts from the fully extended position to the fully retracted position over one or several minutes or longer (such as between 2-5 minutes). It will be noted, that any suitable rate may be set for the extension and retraction of the drilling element 354. Thus, in some embodiments, the earth-boring tool 200 (FIG. 2) may act as a self-adjusting drill bit such as the self-adjusting drill bit described in U.S. Pat. App. Pub. No. 2015/0191979 A1, to Jain et al., filed Oct. 6, 2014, the disclosure of which is incorporated in its entirety herein by this reference; however, the flowrates of the hydraulic fluid 340, extension and retraction rates of the drilling element 354, and positions of drilling element 354 of the self-adjusting drill bit may be actively controlled in real time.

In some embodiments, the viscosities of the hydraulic fluid 340 near and around the first and second flow control devices 348, 350 may be set to position the drilling element 354 relative to the bit body 202 (FIG. 2). For example, the drilling element 354 may be held in a particular position relative to the bit body 202 by greatly increasing the viscosities (e.g., locking the flow) of the hydraulic fluid 340 near and around one or more of the first and second flow control devices 348, 350. For example, greatly increasing the viscosity (e.g., locking the flow) of the hydraulic fluid 340 near the first flow control device 348 within the first fluid flow path 344 while not increasing the hydraulic fluid 340 near the second flow control device 350 within the second fluid flow path 346 may result in the drilling element 354 fully extending and remaining in a fully extended position. Furthermore, greatly increasing the viscosity (e.g., locking the flow) of the hydraulic fluid 340 near the second flow control device 350 within the second fluid flow path 346 while not increasing the hydraulic fluid 340 near the first flow control device 348 within the first fluid flow path 344 may result in the drilling element 354 fully retracting and remaining in a fully retracted position. Moreover, greatly increasing the viscosity (e.g., locking the flow) of the hydraulic fluid 340 near both of the first and second flow control devices 348, 350 within the first and second fluid flow paths 344, 346 may hold the drilling element 354 in a position relative to the surface 230 (FIG. 2) of the bit body 202 (FIG. 2). For example, the drilling element 354 may be held in a position between a fully retracted and fully extended position. In some embodiments, at least one sensor 140 (FIG. 1) of the sensors 140 may sense (e.g., determine) a position of the drilling element 354 relative to the surface 230 (FIG. 2) of the bit body 202 (FIG. 2). Furthermore, in some embodiments, the drilling element 354 may be positioned in a particular position (e.g., a desired position) relative to the surface 230 (FIG. 2) of the bit body 202 (FIG. 2) by using information provided by the sensors 140 (FIG. 1) and by greatly increasing the viscosity (e.g., locking the flow) of the hydraulic fluid 340 near both of the first and second flow control devices 348, 350 within the first and second fluid flow paths 344, 346 when the drilling element 354 is positioned in the particular position. Thus, by increasing and/or decreasing the viscosity of the hydraulic fluid 340 in and around the first and second flow control devices 348, 350 within the first and second fluid flow path 344, 346 the first and first and second rate controllers 362, 364 can effectively position the drilling element 354 at a desired position relative to the drill bit surface 230 (FIG. 2).

The viscosity of the hydraulic fluid 340 may be controlled (e.g., changed and/or set) by controlling a level of magnetic flux density exhibited by the magnetic field produced by the first and second electromagnets. For example, increasing the magnetic flux density of the magnetic field produced by the electromagnets may increase the viscosity of the hydraulic fluid 340. Removing or decreasing the magnetic field (i.e., decreasing the magnetic flux density of the magnetic field produced by the electromagnets) may decrease the viscosity of the hydraulic fluid 340. Thus, the viscosity of the hydraulic fluid 340 may be actively controlled in real time by controlling the first and second electromagnets to produce magnetic fields with certain magnetic flux densities. In some embodiments, the first and second magnets may each include a plurality of electromagnetic coils that may produce a magnetic field in a space between the plurality of electromagnetic coils.

In some embodiments, the hydraulic fluid 340 may include an electro-rheological fluid and the first and second rate controllers 362, 364 may include any known device for producing an electromagnetic field. For example, the first and second rate controllers 362, 364 may include electrodes that generate an electric field, or the first and second rate controllers 362, 364 may include electromagnets that are configured to continuously vary magnetic fields produced by the electromagnets, which may in turn produce an electromagnetic field. Furthermore, when the hydraulic fluid 340 includes an electro-rheological fluid, the flowrates of the hydraulic fluid 340 and, as result, the extension rates, retraction rates, and positions of the drilling element 354 may be controlled in the same manner as described above with regard to embodiments where the hydraulic fluid 340 includes a magneto-rheological fluid.

Referring to FIGS. 1, 2, and 3 together, in some embodiments, the first and second rate controllers 362, 264 may be actively controlled by one or more of the surface control unit 128 and the controller unit 142. For example, the surface control unit 128 and/or the controller unit 142 may provide electrical signals, power, and/or communication signals to the first and second rate controllers 362, 364 via the lines 363, 365 to operate the first and second rate controllers 362, 364. For example, in some embodiments, the lines 363, 365 may extend from the first and second rate controllers 362, 364, respectively, to the controller unit 142, which may be disposed within the earth-boring tool 200 (e.g., within the shank 206 and/or the crown 208 of the bit body 202), and the controller unit 142 may be in communication with the surface control unit 128 via the two-way telemetry unit 150.

In some embodiments, an operator operating the drill string 110 and drilling assembly 114 may actively control the viscosity of the hydraulic fluid 340 via the first and second rate controllers 362, 364 and, as a result, the rates at which the drilling element 354 retracts and extends (e.g., moves through the inward and outward strokes) and the position of the drilling element 354 relative to the surface 230 based on conditions in the wellbore 102 in real time. In some embodiments, the viscosity of the hydraulic fluid 340 may be automatically actively controlled by one or more of the surface control unit 128 and the controller unit 142 based on data acquired by the one or more of the sensors 140. For example, one or more of the sensors 140 may acquire data about a condition downhole, and the surface control unit 128 and/or the controller unit 142 may adjust to the viscosity of the hydraulic fluid 340 in response to the condition. Such conditions may include formation 118 characteristics, vibrations (torsional, lateral, and axial), WOB, sudden changes in DOC, desired ROP, stick-slip, temperature, pressure, depth of wellbore, etc.

Accordingly, multiple levels of exposure of the drilling element 154 of the earth-boring tool 200 may be available in real time. For example, the self-adjusting aspects of the actuation device 356, as described above, may provide continuously varying DOC control to suit to drilling conditions while active control can turn the DOC control on or off on demand and can adjust the flowrates of the hydraulic fluid 340 and positions of the drilling element 354 on demand. Furthermore, actively controlling flowrates, rates of extension of the drilling element 354, rates of retraction of the drilling element 354, and drilling element 354 positions may mitigate torsional, axial, and/or lateral vibrations.

Figure 4A:
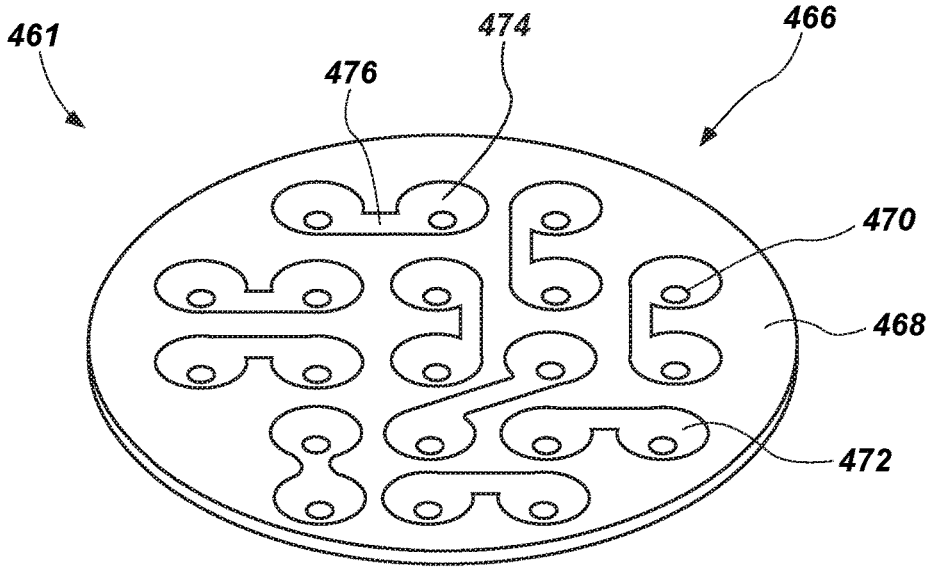
FIG. 4A is a perspective view of a restrictor that may be used in an actuation device as disclosed herein according to an embodiment of the present disclosure.

FIG. 4A shows a restrictor 461 that may be used with the actuation devices described herein according to an embodiment of the present disclosure. For example, the restrictor 461 may include a multi-stage orifice 466 having at least one plate 468, a plurality of orifices 470 extending through the at least one plate 468, and a plurality of fluid pathways 472 defined in the at least one plate 468 and surrounding each orifice 470 of the plurality of orifices 470. The plurality of fluid pathways 472 may include a plurality of circular channels 474, each circular channel 474 of the plurality of circular channels 474 surrounding a respective orifice 470 of the plurality of orifices 470 and leading to the respective orifice 470 (e.g., the circular channels 474 may act as funnels for the orifices 470). The plurality of fluid pathways 472 may further include a plurality of linear channels 476 extending between adjacent circular channels 474 of the plurality of circular channels 474. The plurality of fluid pathways 472 and plurality of orifices 470 may define a tortuous pathway for the hydraulic fluid 340 (FIG. 3) to travel when flowing through the restrictor 461, and thus, may increase an effectiveness of changing a viscosity of the hydraulic fluid 340 (FIG. 3) in changing a flowrate of the hydraulic fluid 340 (FIG. 3) through the restrictor 461. In some embodiments, the restrictor 461 may include a single plate 468. In other embodiments, the restrictor 461 may include a plurality of plates 468 oriented parallel to each other.

Figure 4B:
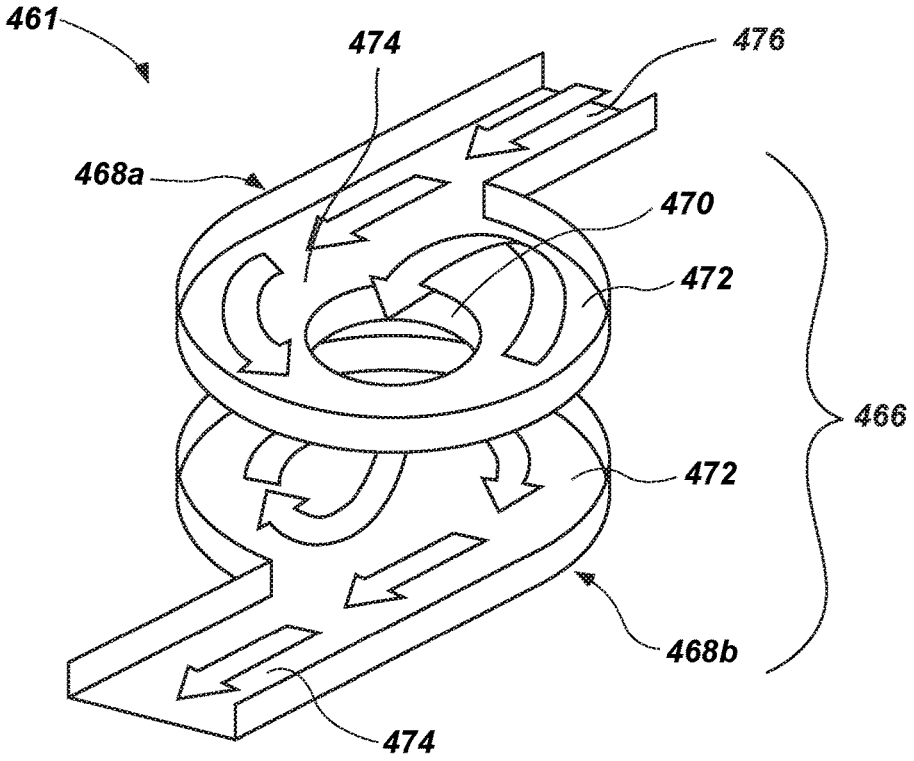
FIG. 4B is a partial perspective view of a restrictor including a multi-stage orifice according to an embodiment of the present disclosure.

FIG. 4B is an enlarged partial perspective view of a restrictor 461 according to an embodiment of the present disclosure. In some embodiments, the restrictor 461 may include a multi-stage orifice 466 having a plurality of plates 468. For example, the multi-stage orifice 466 may include a first plate 468*a* and a second plate 468*b* oriented parallel to each other. The first plate 468*a* may include a plurality of orifices 470 and a plurality of fluid pathways 472. The second plate 468*b* may also include a plurality of orifices 470 and a plurality of fluid pathways 472. However, portions of the second plate 468*b* that are directly adjacent to the plurality of orifices 470 of the first plate 468*a* may not include an orifice 470 but rather, may include a circular channel 474 and a linear channel 476 leading to another portion of the second plate 468*b* having an orifice 470. As a result, the orientation and design of the first plate 468*a* relative to the orientation and design of the second plate 468*b* may increase a distance the hydraulic fluid 340 (FIG. 3) must travel to pass through the restrictor 461 and may increase the effectiveness of changing a viscosity of the hydraulic fluid 340 (FIG. 3) in changing a flowrate of the hydraulic fluid 340 (FIG. 3).

Figure 5:
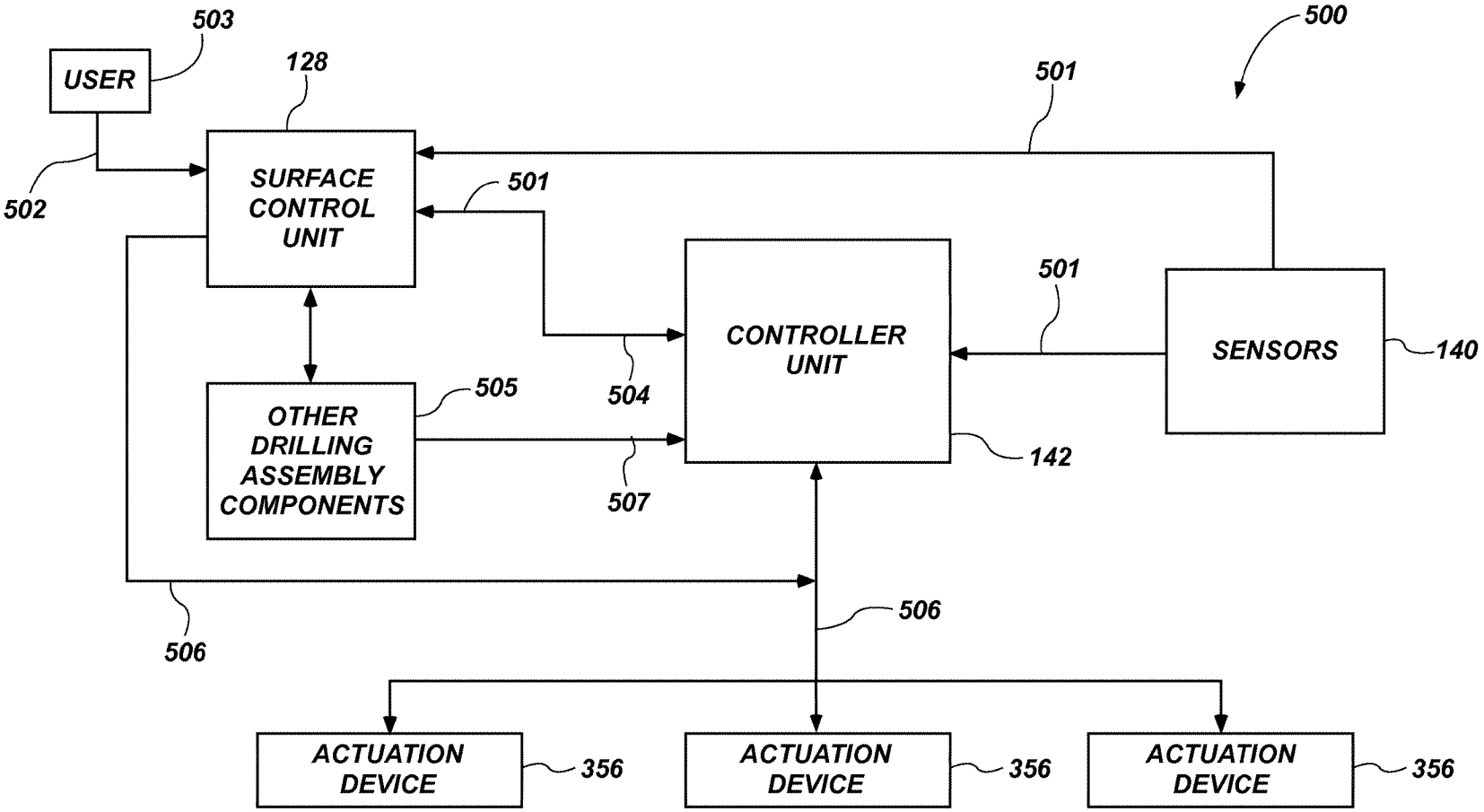
FIG. 5 is a schematic view of a controller system of an actively controlled self-adjusting bit according to an embodiment of the present disclosure.

FIG. 5 shows a schematic representation of a controller system 500 used to actively control the actuation devices described herein according to an embodiment of the present disclosure. Referring to FIGS. 1, 3, and 5 together, for example, during a drilling operation, one or more of the downhole sensors 140 of the earth-boring tool 200 may determine (e.g., sense) a condition in the wellbore 102. For example, the sensors 140 may sense accelerations (e.g., vibrations), WOB, torque, pressure, drilling element positions, ROP, inclination, azimuth formation/lithology, etc. In some embodiments, the sensors 140 may detect torsional, lateral, and/or axial vibrations of the earth-boring tool 200. After determining a condition, the sensors 140 may communicate with the controller unit 142 and may relay information 501 related to the condition to the controller unit 142. After receiving information 501 about the condition, in some embodiments, the controller unit 142 may diagnose the condition. In other words, the controller unit 142 may determine if the condition poses a problem to the drilling operation of the drilling system 100 and whether adjusting a rate of extension, rate of retraction, and/or position of the drilling element 354 would mitigate the condition. Thus, the controller unit 142 may determine if corrective action related to the rate of extension, rate of retraction, and/or position of the drilling element 354 is needed based on the conditions of the wellbore 102.

In some embodiments, the controller unit 142 may relay the information 501 related the condition to the surface control unit 128 instead of or in addition to diagnosing the condition, and the surface control unit 128 may diagnose the condition. In some embodiments, the surface control unit 128 may receive user inputs 502 (e.g., commands from an operator 503 of the earth-boring tool 200) while diagnosing the condition.

In some embodiments, once the condition is diagnosed and an appropriate corrective action has been determined, the controller unit 142 may receive a command 504 from the surface control unit 128 in regard to the corrective action. For example, the controller unit 142 may receive a command to change a rate at which the drilling element 354 is extending or retracting. In other embodiments, where the controller unit 142 solely diagnoses the condition, the controller unit 142 will determine whether to extend, retract, and/or adjust a position of the drilling element 354.

The controller unit 142 may then actuate (e.g., communicate with and control 506) the first and second rate controllers 362, 364 to achieve desired flowrates and/or positions of the drilling element 354 relative to the surface 230. For example, the controller unit 142 may actuate the first and second rate controllers 362, 364 to produce magnetic fields of certain magnetic flux densities in order to adjust viscosities of the hydraulic fluid 340 within the first and second fluid flow path 344, 346. As a result, the controller unit 142 may control the flowrates of the hydraulic fluid 340 between the first and second fluid chambers 352, 358 of the actuation device 356. Consequently, the controller unit 142 may control rates of extension, rates of retraction, and/or positions of the drilling element 354.

In some embodiments, other drill assembly components 505 may assist in diagnosing conditions and/or giving commands 507 to the controller unit 142. In some embodiments, the surface control unit 128 may solely control the first and second rate controllers 362, 364 without assistance from a controller unit 142 within the bit body 202. In some embodiments, the first and second rate controllers 362, 364 may be solely controlled at the surface control unit 128 by an operator 503 of the drilling assembly 114 (FIG. 1). In some embodiments, the controller system 500 may control a plurality of actuation devices 356 in a single earth-boring tool 200.

In some embodiments, the controller unit 142 may be disposed within the bit body 202 of the earth-boring tool 200. However, it is noted that the controller unit 142 may be disposed anywhere along the drill string 110 of the drilling system 100.

Figure 6:
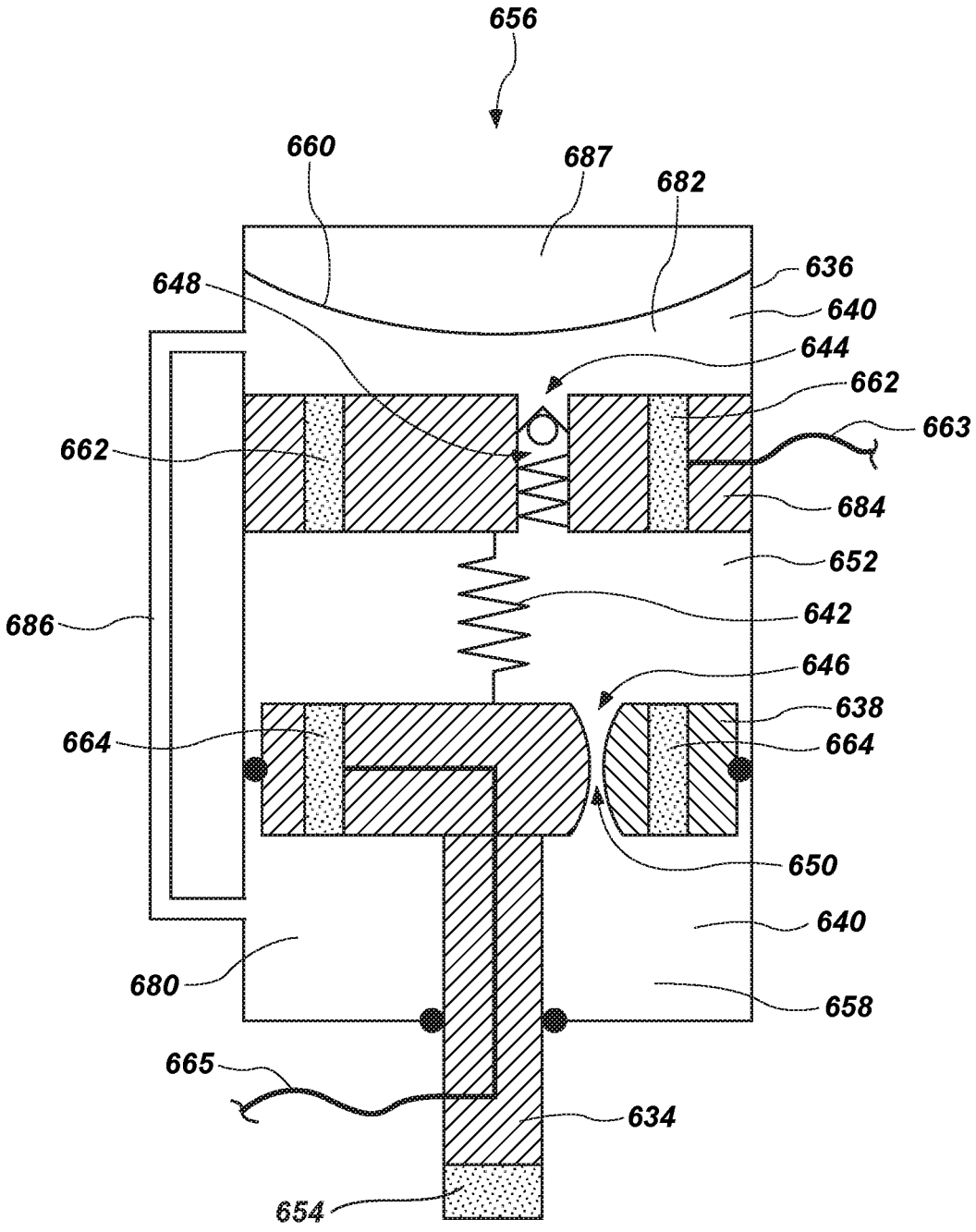
FIG. 6 is a schematic representation of an actuation device of an actively controlled self-adjusting bit according to another embodiment of the present disclosure.

FIG. 6 is a schematic view of an actuation device 656 for an actively controlled self-adjusting earth-boring tool 200 (FIG. 2) according to another embodiment of the present disclosure. Similar to the actuation device 356 described above in regard to FIG. 3, the actuation device 656 may include a connection member 634, a chamber 636, a reciprocating member 638, a hydraulic fluid 640, a biasing member 642, a first fluid flow path 644, a second fluid flow path 646, a first flow control device 648, a second flow control device 650, a pressure compensator 660, and a drilling element 654. Furthermore, the chamber 636 may include a first fluid chamber 652 and a second fluid chamber 658. The actuation device 656 may operate in substantially the same manner as the actuation device 356 described in regard to FIG. 3.

However, the second fluid chamber 658 may include a first portion 680 and a second portion 682. The first portion 680 of the second fluid chamber 658 may be oriented on a first side of the first fluid chamber 652, and the second portion 682 of the second fluid chamber 658 may be oriented on a second opposite side of the first fluid chamber 652. The first portion 680 of the second fluid chamber 658 may be sealingly isolated from the first fluid chamber 652 by the reciprocating member 638 (e.g., piston). Furthermore, the second portion 682 of the second fluid chamber 658 may be isolated from the first fluid chamber 652 by a divider member 684. In some embodiments, the divider member 684 is stationary relative the first and second fluid chambers 652, 658.

The first fluid flow path 644 may extend from the second portion 682 of the second fluid chamber 658 to the first fluid chamber 652 through the divider member 684. The first flow control device 648 may be disposed within the first fluid flow path 644 and may include one or more of a first check valve and a first restrictor. Furthermore, the first fluid flow path 644 and first flow control device 648 may operate in the same manner as the first fluid flow path 344 and first flow control device 348 described in regard to FIG. 3.

The second fluid flow path 646 may extend from the first fluid chamber 652 to the first portion 680 of the second fluid chamber 658 through the reciprocating member 638. The second flow control device 650 may be disposed within the second fluid flow path 646 and may include one or more of a second check valve and a second restrictor. Furthermore, the second fluid flow path 646 and second flow control device 650 may operate in the same manner as the second fluid flow path 346 and second flow control device 350 described in regard to FIG. 3.

The second portion 682 of the second fluid chamber 658 may be in fluid communication with the first portion 680 of the second fluid chamber 658 via a third fluid flow path 686. The second portion 682 of the second fluid chamber 658 may also be in fluid communication with the pressure compensator 660, and pressure compensator 660 may be configured to at least substantially balance the pressure of the second fluid chamber 658 with the environment pressure of an environment 687 (e.g., mud of the wellbore 102 (FIG. 1)), as discussed above in regard to FIG. 3.

The actuation device 656 may include a first rate controller 662 and a second rate controller 664 for adjusting the fluid properties of the hydraulic fluid 640. The first rate controller 662 and second rate controller 664 may operate in substantially the same manner as discussed above in regard to FIG. 3. As shown in FIG. 6, in some embodiments, the first rate controller 662 may be disposed within the divider member 684 and may be configured to control the flowrate of the hydraulic fluid 640 through the first flow control device 648 and the first fluid flow path 644. In some embodiments, the second rate controller 664 may be disposed within the reciprocating member 638 and may be configured to control the flowrate of the hydraulic fluid 640 through the second flow control device 650 and the second fluid flow path 646. The first rate controller 662 and the second rate controller 664 may have lines 663, 665, respectively, for communication with one or more of the surface control unit 128 (FIG. 1) and the controller unit 142 (FIG. 1). In some embodiments, line 663 may extend at least partially through the divider member 684. In some embodiments, line 665 may extend at least partially through the reciprocating member 638 and connection member 634.

Figure 7:
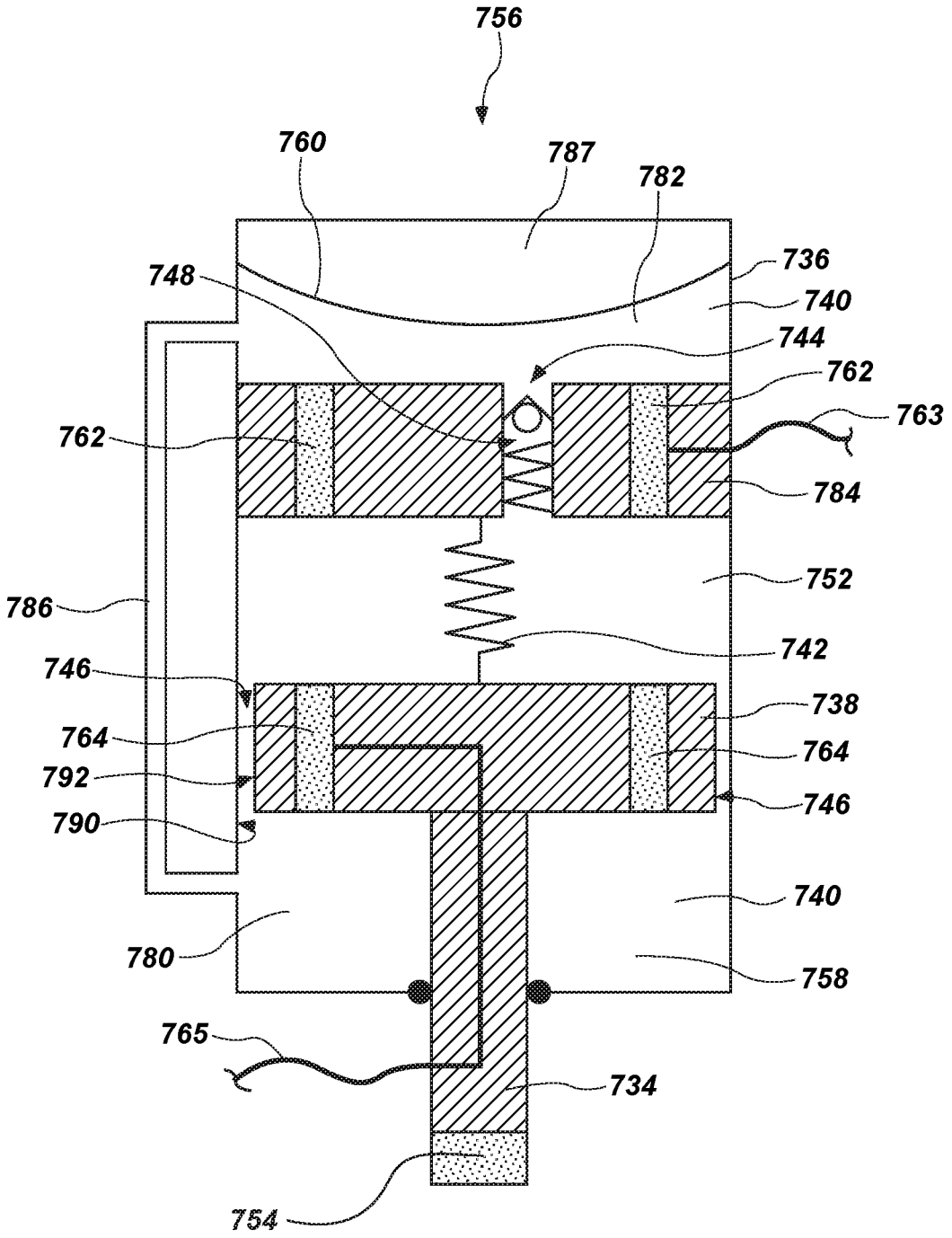
FIG. 7 is a schematic representation of an actuation device of an actively controlled self-adjusting bit according to another embodiment of the present disclosure.

FIG. 7 is a schematic view of an actuation device 756 for an actively controlled self-adjusting earth-boring tool 200 (FIG. 2) according to another embodiment of the present disclosure. Similar to the actuation device 656 described above in regard to FIG. 6, the actuation device 756 may include a connection member 734, a chamber 736, a reciprocating member 738, a hydraulic fluid 740, a biasing member 742, a first fluid flow path 744, a second fluid flow path 746, a third fluid flow path 786, a first flow control device 748, a pressure compensator 760, and a drilling element 754. Furthermore, the chamber 736 may include a first fluid chamber 752 and a second fluid chamber 758. The second fluid chamber 758 may include a first portion 780 and a second portion 782, the first portion 780 may be oriented on a first side of the first fluid chamber 752 and the second portion 782 may be oriented on a second opposite side of the first fluid chamber 752. The first portion 780 of the second fluid chamber 758 may be isolated from the first fluid chamber 752 by the reciprocating member 738 (e.g., piston). Furthermore, the second portion 782 of the second fluid chamber 758 may be isolated from the first fluid chamber 752 by a divider member 784. The actuation device 756 may operate in substantially the same manner as the actuation device 656 described in regard to FIG. 6.

However, the second fluid flow path 746 may extend from the first fluid chamber 752 to the first portion 780 of the second fluid chamber 758 around the reciprocating member 738. For example, the second fluid flow path 746 may include an annular gap between an inner surface 790 of the chamber 736 and an outer peripheral surface 792 of the reciprocating member 738. Furthermore, the second rate controller 764 may be disposed within the reciprocating member 738 and may be configured to control a flowrate of the hydraulic fluid 740 through the annular gap.

Figure 8:
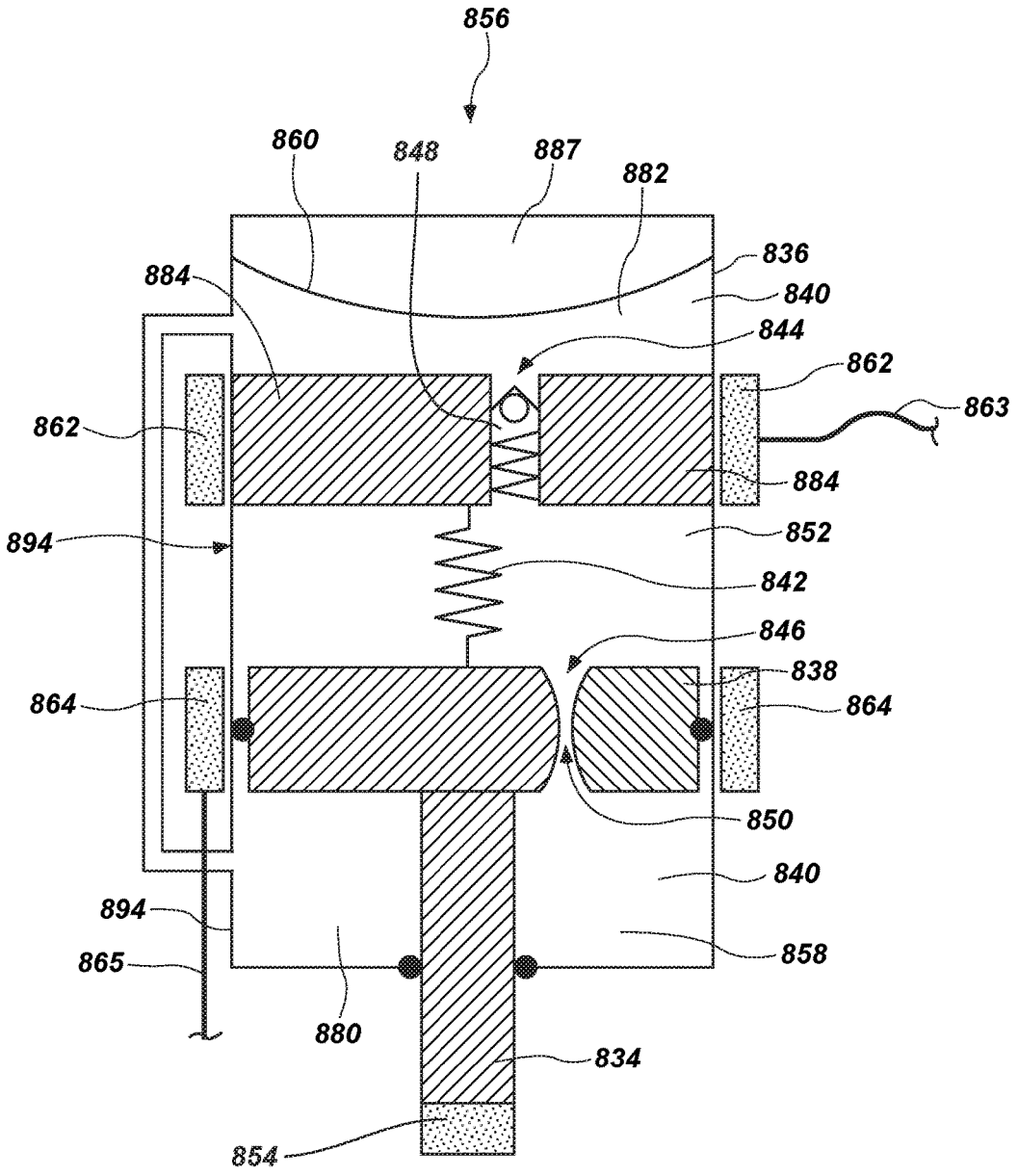
FIG. 8 is a schematic representation of an actuation device of an actively controlled self-adjusting bit according to another embodiment of the present disclosure.

FIG. 8 is a schematic view of an actuation device 856 for an actively controlled self-adjusting earth-boring tool 200 (FIG. 2) according to another embodiment of the present disclosure. Similar to the actuation device 656 described above in regard to FIG. 6, the actuation device 856 may include a connection member 834, a chamber 836, a reciprocating member 838, a hydraulic fluid 840, a biasing member 842, a first fluid flow path 844, a second fluid flow path 846, a first flow control device 848, a second flow control device 850, a pressure compensator 860, and a drilling element 854. Furthermore, the chamber 836 may include a first fluid chamber 852 and a second fluid chamber 858. The second fluid chamber 858 may include a first portion 880 and a second portion 882, the first portion 880 may be oriented on a first side of the first fluid chamber 852 and the second portion 882 may be oriented on a second opposite side of the first fluid chamber 852. The first portion 880 of the second fluid chamber 858 may be isolated from the first fluid chamber 852 by the reciprocating member 838 (e.g., piston). Furthermore, the second portion 882 of the second fluid chamber 858 may be isolated from the first fluid chamber 852 by a divider member 884. The actuation device 856 may operate in substantially the same manner as the actuation device 656 discussed above in regard to FIG. 6.

However, the first and second rate controllers 862, 864 may be external to the chamber 836 of the actuation device 856. In other words, the first and second rate controllers 862, 864 may be disposed around an external wall 894 of the chamber 836. The first rate controller 862 may be aligned axially with the divider member 884 along a longitudinal axis of the actuation device 856. The second rate controller 864 may be at least substantially aligned axially with a pathway of the reciprocating member 838 of the actuation device 856 along the longitudinal axis of the actuation device 856. For example, the second rate controller 864 may extend axially along the longitudinal axis of the actuation device 856 the full length of a pathway the reciprocating member 838 travels during inward and outward strokes.

Figure 9:
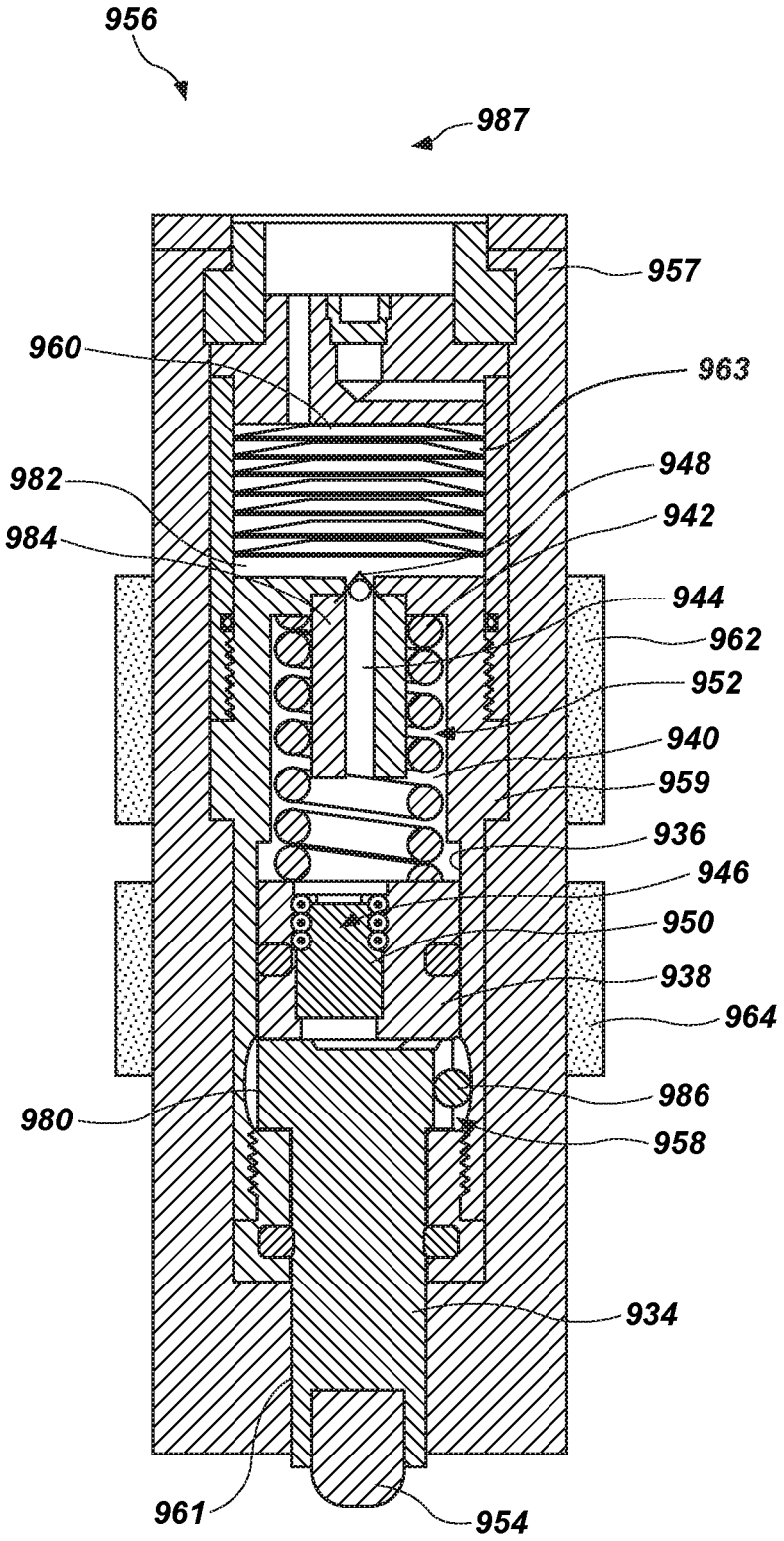
FIG. 9 is a cross-sectional view of an example implementation of the actuation device of FIG. 8.

FIG. 9 is a cross-sectional view of an example implementation of the actuation device of an actively controlled self-adjusting bit of FIG. 8. The actuation device 956 may be similar to the actuation device 856 shown in FIG. 8 and described above. The actuation device 956 may be configured to be press fitted into a crown 208 of a bit body 202 (FIG. 2) of an earth-boring tool 200 (FIG. 2). The actuation device 956 may include an external casing 957, an internal casing 959, a pressure compensator housing 963, a connection member 934, an internal chamber 936, a reciprocating member 938, a hydraulic fluid 940, a biasing member 942, a first fluid flow path 944, a second fluid flow path 946, a first flow control device 948, a second flow control device 950, a pressure compensator 960, and a drilling element 954. Furthermore, the internal chamber 936 may include a first fluid chamber 952 and a second fluid chamber 958. The second fluid chamber 958 may include a first portion 980 and a second portion 982, the first portion 980 oriented on a first side of the first fluid chamber 952 and the second portion 982 oriented on a second opposite side of the first fluid chamber 952. The first portion 980 of the second fluid chamber 958 may be isolated from the first fluid chamber 952 by the reciprocating member 938 (e.g., piston). Furthermore, the second portion 982 of the second fluid chamber 958 may be isolated from the first fluid chamber 952 by a divider member 984.

Referring to FIGS. 2 and 9 together, the external casing 957 may define an inner cavity that houses the internal casing 959 and the pressure compensator housing 963. In some embodiments, the external casing 957 may be a portion of the crown 208 of the bit body 202 of the earth-boring tool 200. In other embodiments, the external casing 957 may be distinct from the bit body 202 of the earth-boring tool 200. The external casing 957 may also have an extension hole 961 defined at one end thereof. In some embodiments, the pressure compensator housing 963 may define the second portion 982 of the second fluid chamber 958. The pressure compensator 960 may be disposed within the pressure compensator housing 963 and may be in fluid communication on a first side with the second portion 982 of the second fluid chamber 958 and may be at least partially disposed within the second portion 982 of the second fluid chamber 958. The pressure compensator 960 may include one or more of a bellows, diaphragm, and pressure compensator valve and may be in communication on a second side with an environment 987 (e.g., mud of the wellbore 102 (FIG. 1). The pressure compensator 960 may be configured to at least substantially balance a pressure of the second fluid chamber 958 with an environment 987 pressure (e.g., pressure outside of the earth-boring tool 200 (FIG. 2)). In other words, the pressure compensator 960 may help maintain a pressure of the second fluid chamber 958 that is at least substantially equal to the environment 987 pressure. The first fluid chamber 952 may have a pressure that is higher than the pressure of the second fluid chamber 958.

The internal casing 959 may define an inner cavity that forms the internal chamber 936. The internal chamber 936 may house the reciprocating member 938, and the reciprocating member 938 may sealingly divide the internal chamber 936 into the first fluid chamber 952 and the first portion 980 of the second fluid chamber 958. The connection member 934 may be attached to the reciprocating member 938 at a first end of the connection member 934 and on a portion of the reciprocating member 938 in the first portion 980 of the second fluid chamber 958. The connection member 934 may extend through the second fluid chamber 958 and through the extension hole 961 of the external casing 957 of the actuation device 956. The drilling element 954 may be attached to a second end of the connection member 934 opposite the first end such that that drilling element 954 may be extended and retracted through the extension hole 961 of the external casing 957 of the actuation device 956.

The hydraulic fluid 940 may be disposed within the first fluid chamber 952 and the second fluid chamber 958 and may at least substantially fill the first fluid chamber 952 and the second fluid chamber 958. The hydraulic fluid 940 may include one or more of an electro- or magneto-rheological fluids. The biasing member 942 may be disposed within the first fluid chamber 952 and may be configured to apply a selected force on the reciprocating member 938 to cause the reciprocating member 938 to move through the second fluid chamber 958 outwardly (e.g., toward the extension hole 961 of the external casing 957). Furthermore, the pressure differential between the first fluid chamber 952 and the second fluid chamber 958 may assist in moving the reciprocating member 938 outward. As result, the biasing member 942 may cause the connection member 934 and drilling element 954 to move outwardly (e.g., may cause the drilling element 954 to extend). In some embodiments, the biasing member 942 may include a spring.

The first fluid flow path 944 may extend from the second portion 982 of the second fluid chamber 958 to the first fluid chamber 952 through the divider member 984. The first flow control device 948 may be disposed within the first fluid flow path 944. Furthermore, the first flow control device 948 may be configured to control the flowrate of the hydraulic fluid 940 from the second fluid chamber 958 to the first fluid chamber 952. In some embodiments, the first flow control device 948 may include one or more of a first check valve and a first restrictor. In some embodiments, the first restrictor may include a multi-stage orifice 466 (FIGS. 4A and 4B). In some embodiments, the first flow control device 948 may include only the first check valve. In other embodiments, the first flow control device 948 may include only the first restrictor. In other embodiments, the first flow control device 948 may include both the first check valve and the first restrictor.

The second fluid flow path 946 may extend from the first fluid chamber 952 to the second fluid chamber 958 and may allow the hydraulic fluid 940 to flow from the first fluid chamber 952 to the second fluid chamber 958. The second flow control device 950 may be disposed within the second fluid flow path 946. Furthermore, the second flow control device 950 may be configured to control the flowrate of the hydraulic fluid 940 from the first fluid chamber 952 to the second fluid chamber 958. In some embodiments, the second flow control device 950 may include one or more of second check valve and a second restrictor. In some embodiments, the second restrictor may include a multi-stage orifice 466 (FIGS. 4A and 4B). In some embodiments, the second flow control device 950 may include only the second check valve. In other embodiments, the second flow control device 950 may include only the second restrictor. In other embodiments, the second flow control device 950 may include both the second check valve and the second restrictor.

The second portion 982 of the second fluid chamber 958 may be in fluid communication with the first portion 980 of the second fluid chamber 958 via a third fluid flow pathway 986. In some embodiments, the third fluid flow pathway 986 may include an aperture extending through the internal casing 959.

The actuation device 956 may include a first rate controller 962 and a second rate controller 964 for adjusting the fluid properties of the hydraulic fluid 940. The first rate controller 962 and second rate controller 964 may operate in substantially the same manner as discussed above in regard to FIG. 3. As shown in FIG. 9, in some embodiments, the first and second rate controllers 962, 964 may be disposed external to the external casing 957. For example, the first and second rate controllers 962, 964 may be disposed outside external casing 957 of the actuation device 956. In other words, the first and second rate controllers 962, 964 may be configured to be embedded directly into the crown 208 of the bit body 202 of the earth-boring tool 200. The first rate controller 962 may be aligned axially with the divider member 984 along a longitudinal axis of the actuation device 956. The second rate controller 964 may be at least substantially aligned axially with a pathway of the reciprocating member 938 of the actuation device 956 along the longitudinal axis of the actuation device 956. For example, the second rate controller 964 may extend axially along the longitudinal axis of the actuation device 956 the full length of a pathway the reciprocating member 938 travels during inward and outward strokes.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. An earth-boring tool, comprising:

a body;

an actuation device disposed at least partially within the body, the actuation device comprising:

a first fluid chamber;

a second fluid chamber;

at least one reciprocating member dividing the first fluid chamber from the second fluid chamber, the at least one reciprocating member configured to reciprocate back and forth within the first fluid chamber and the second fluid chamber;

a hydraulic fluid disposed within and at least substantially filling the first fluid chamber and the second fluid chamber;

a connection member attached to the at least one reciprocating member at a portion of the at least one reciprocating member facing the second fluid chamber, the connection member extending out of the second fluid chamber;

a divider member dividing the first fluid chamber from the second fluid chamber;

a first fluid flow path extending from the second fluid chamber to the first fluid chamber through the divider member;

a second fluid flow path extending from the first fluid chamber to the second fluid chamber through the reciprocating member;

a first flow controller disposed within the first fluid flow path;

a second flow controller disposed within the second fluid flow path;

a first rate controller disposed proximate the first fluid flow path and the first flow controller and within the divider member, the first rate controller configured to control a flowrate of the hydraulic fluid through the first fluid flow path and the first flow controller by adjusting a viscosity of the hydraulic fluid;

a second rate controller disposed within the reciprocating member and configured to control a flowrate of the hydraulic fluid through the second fluid flow path and the second flow controller; and a drilling element attached to the connection member of the actuation device, wherein the drilling element comprises one or more of cutting elements, pads, elements making rolling contact, elements for reducing friction with formations, PDC bit blades, cones, elements for altering junk slot geometry, or bearing elements.

2. The earth-boring tool of claim 1, wherein the hydraulic fluid of the actuation device comprises a magneto-rheological fluid.

3. The earth-boring tool of claim 1, wherein the hydraulic fluid of the actuation device comprises an electro-rheological fluid.

4. The earth-boring tool of claim 1, wherein the first rate controller comprises an electromagnet.

5. The earth-boring tool of claim 1, wherein the first rate controller comprises an electrode.

6. The earth-boring tool of claim 1, wherein the actuation device further comprises a biaser disposed within the first fluid chamber and configured to exert a force on the at least one reciprocating member.

7. The earth-boring tool of claim 1, wherein a pressure of the second fluid chamber is at least substantially equal to an environment pressure.

8. An earth-boring tool, comprising:

a body;

an actuation device disposed at least partially within the body, the actuation device comprising:

a first fluid chamber;

a second fluid chamber having a first portion and a second portion;

at least one reciprocating member dividing the first fluid chamber from the first portion of the second fluid chamber, the at least one reciprocating member configured to reciprocate back and forth within the first fluid chamber and the first portion of the second fluid chamber;

a connection member attached to the reciprocating member at a portion of the reciprocating member facing the first portion of the second fluid chamber, the connection member extending out of the second fluid chamber;

a divider member dividing the first fluid chamber from the second portion of the second fluid chamber;

a first fluid flow path extending from the second portion of the second fluid chamber to the first fluid chamber through the divider member;

a second fluid flow path extending from the first fluid chamber to the first portion of the second fluid chamber through the reciprocating member;

a first rate controller extending around the first fluid flow path and disposed within the divider member, the first rate controller configured to control a flowrate of a hydraulic fluid through the first fluid flow path; and a second rate controller extending around the second fluid flow path and disposed within the reciprocating member, the second rate controller configured to control a flowrate of the hydraulic fluid through the second fluid flow path; and a drilling element attached to the connection member of the actuation device, wherein the drilling element comprises one or more of cutting elements, pads, elements making rolling contact, elements for reducing friction with formations, PDC bit blades, cones, elements for altering junk slot geometry, or bearing elements.

9. The earth-boring tool of claim 8, wherein the actuation device further comprises:

a first flow controller disposed within the first fluid flow path; and a second flow controller disposed within the second fluid flow path.

10. The earth-boring tool of claim 8, wherein the first and second rate controllers comprise electromagnets.

11. The earth-boring tool of claim 10, wherein the first and second rate controllers are configured to produce magnetic fields and to continuously vary the magnetic fields.

12. The earth-boring tool of claim 8, wherein the first and second rate controllers comprise electrodes.

13. The earth-boring tool of claim 8, further comprising a control unit disposed within the earth-boring tool and configured to control a viscosity of the hydraulic fluid within at least a portion of the first fluid flow path and at least a portion of the second fluid flow path via the first rate controller and the second rate controller.

14. The earth-boring tool of claim 8, wherein the actuation device further comprises a pressure compensator in fluid communication with the second portion of the second fluid chamber and configured to at least substantially balance a pressure of the second fluid chamber with an environment pressure.

15. An actuation device for an actively controlled self-adjusting earth-boring tool, the actuation device comprising:

an external casing;

an internal casing housed by the external casing;

a pressure compensator housing housed by the external casing;

an internal chamber defined within the internal casing;

a reciprocating member sealingly dividing the internal chamber into a first fluid chamber and a first portion of a second fluid chamber, wherein the pressure compensator housing defines a second portion of the second fluid chamber;

a connection member attached to a portion of the reciprocating member facing the first portion of the second fluid chamber, wherein the connection member extends through the second fluid chamber and through an extension hole defined in the external casing;

a divider member dividing the first fluid chamber from the second portion of the second fluid chamber;

a drilling element attached to the connection member and configured to be extended and retracted through the extension hole of the external casing, wherein the drilling element comprises one or more of cutting elements, pads, elements making rolling contact, elements for reducing friction with formations, PDC bit blades, cones, elements for altering slot junk geometry, or bearing elements;

a first fluid flow path having a first flow controller disposed therein extending from the second portion of the second fluid chamber to the first fluid chamber through the divider member;

a second fluid flow path having a second flow controller disposed therein extending from the first fluid chamber to the first portion of the second fluid chamber through the reciprocating member, wherein the first portion of the second fluid chamber is in fluid communication with the second portion of the second fluid chamber via a third fluid flow path;

a first rate controller disposed proximate the first flow controller of the first fluid flow path and within the divider member and comprising a first electromagnet; and a second rate controller disposed proximate the second flow controller of the second fluid flow path and within the reciprocating member and comprising a second electromagnet.

16. The actuation device of claim 15, wherein the first rate controller is configured to control a flowrate of a hydraulic fluid through the first flow controller of the first fluid flow path by adjusting a viscosity of the hydraulic fluid and wherein the second rate controller is configured to control a flowrate of the hydraulic fluid through the second flow controller of the second fluid flow path by adjusting a viscosity of the hydraulic fluid.

* * * * *